US008764936B2

(12) United States Patent
Laurila-Lumme et al.

(10) Patent No.: US 8,764,936 B2
(45) Date of Patent: Jul. 1, 2014

(54) PROCESS FOR PRODUCING MECHANICAL PULP SUITABLE FOR PAPER OR CARDBOARD MAKING

(75) Inventors: Auli Laurila-Lumme, Lohja (FI); Markku Leskelä, Lohja (FI); Kristiina Manninen, Lohja (FI); Ole Nickull, Tammerfors (FI); Isto Nikamaa, Kouvola (FI); Marko Pekkola, Lappeenranta (FI); Maija Pitkänen, Jyväskylä (FI); Pirita Suortamo, Palokka (FI); Kai E. J. Vikman, Lohja (FI)

(73) Assignee: M-real Oyj, Espoo (FI)

( * ) Notice: Subject to any disclaimer, the term of this patent is extended or adjusted under 35 U.S.C. 154(b) by 1344 days.

(21) Appl. No.: 11/919,656

(22) PCT Filed: May 3, 2006

(86) PCT No.: PCT/FI2006/000143

§ 371 (c)(1),
(2), (4) Date: Jul. 25, 2008

(87) PCT Pub. No.: WO2006/128950

PCT Pub. Date: Dec. 7, 2006

(65) Prior Publication Data

US 2009/0032207 A1 Feb. 5, 2009

(30) Foreign Application Priority Data

May 3, 2005 (FI) ..... 20050477

(51) Int. Cl.

| | |
|---|---|
| ***D21C 9/16*** | (2006.01) |
| *D21B 1/12* | (2006.01) |
| *D21D 5/02* | (2006.01) |

(52) U.S. Cl.
CPC *D21C 9/16* (2013.01); *D21C 9/163* (2013.01); *D21C 9/166* (2013.01); *D21B 1/12* (2013.01); *D21D 5/02* (2013.01)
USPC ..... 162/25; 162/55; 162/78

(58) Field of Classification Search
CPC ..... D21C 9/16; D21C 9/162; D21C 9/166
USPC ..... 162/25, 55, 78
See application file for complete search history.

(56) References Cited

U.S. PATENT DOCUMENTS

| | | | | |
|---|---|---|---|---|
| 4,731,160 | A | 3/1988 | Prough et al. | 162/55 |
| 5,145,010 | A * | 9/1992 | Danielsson et al. | 162/26 |

(Continued)

FOREIGN PATENT DOCUMENTS

WO 2004/003288 A1 1/2004

OTHER PUBLICATIONS

Leask ed., Mechnical Pulping, 1987, The Joint textbook Committee of the Paper Industry, third edition, p. 210-216 and 238.*

(Continued)

*Primary Examiner* — Anthony Calandra
(74) *Attorney, Agent, or Firm* — Kubovcik & Kubovcik

(57) ABSTRACT

Method for the production of mechanical or chemi-mechanical pulp as raw material for paper or cardboard. According to this method, the pulp is fibrillated and the fibrillated pulp is bleached in alkaline conditions. According to the present invention, the pulp is screened to separate the reject from the accept, at maximum approximately 60% of the total amount of pulp is separated as the reject, the reject is bleached separate from the accept, and, after that, the bleached reject is remixed with the accept. When operating according to the present invention, the strength of the pulp increases and the energy used for refining is reduced, which is seen both in the refining of the reject and in the post-refining of the final mechanical pulp.

10 Claims, 1 Drawing Sheet

(56) References Cited

U.S. PATENT DOCUMENTS

| | | | | |
|---|---|---|---|---|
| 5,223,090 | A * | 6/1993 | Klungness et al. | 162/9 |
| 2003/0121625 | A1 | 7/2003 | Zhang et al. | 162/24 |
| 2004/0180184 | A1 | 9/2004 | Fillion et al. | 428/211.1 |
| 2008/0029232 | A1 * | 2/2008 | Wikdahl et al. | 162/24 |

OTHER PUBLICATIONS

Sundholm ed., Mechnical pulping, 1999, Fapet Oy., p. 161 and 351-358.*

Smook, Handbook for Pulp and Paper Technologists, 1992, Angus Wilde Publications, 2nd edition, chapter 11.*

Smook, Handbook for Pulp and Paper Technologists, 1992, Angus Wilde Publications, 2nd edition, chapter 4.*

Smook, Handbook of Pulp and Paper Terminology, 1990, Angus Wilde Publications, chapters 11-12.*

Simard et al., Optimization of In-Refiner Brightening with H2O2 for Production of Hi Brite Mechnical Printing Paper, 1995, Spring Conference of Pacific Coast and Western Branches.*

Bian et al. Improving TMP Rejects Refining Through Alkaline Peroxide Pre-Treatment for Value-Added Mechncial Papers, 2007,TAPPI Journal, vol. 6 No. 3.*

Strunk, William G. et al., "High Alkalinity Peroxide Treatment of Groundwood Screen Rejects", 1990 Annual Meeting, pp. B71-B79.

Strunk, W. et al., "Treating Groundwood Screen Rejects with Alkaline Peroxide Ups Pulp Value", *Pulp & Paper*, vol. 63, No. 111 1989, pp. 99-105.

Strunk, William G. et al., "High Strength Softwood Rejects by Bleaching with Peroxide Before Refining", Tappi Ann. Mtg., 1988, pp. 49-61.

* cited by examiner

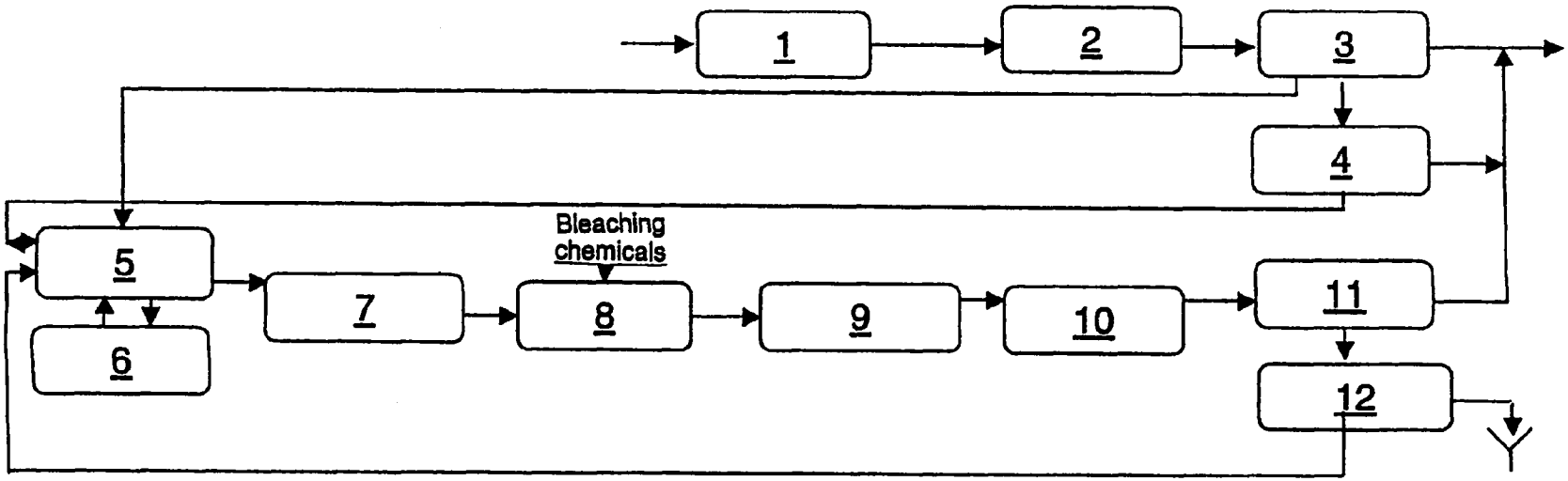
1
2
3
4
5
6
7
8
Bleaching chemicals
9
10
11
12

PROCESS FOR PRODUCING MECHANICAL PULP SUITABLE FOR PAPER OR CARDBOARD MAKING

This application is a 371 of international application PCT/FI2006/000143 filed May 3, 2006, which claims priority based on Finnish patent application No. 20050477 filed May 3, 2005, which is incorporated herein by reference.

The present invention relates to a process according to the preamble of claim 1 for producing mechanical pulp suitable for paper and cardboard making.

In a method such as this, the pulp is fibrillated using methods which are known per se, and the pulp generated is bleached in alkaline conditions.

Utilisation of mechanical pulp made from blocks of wood, more specifically groundwood pulp, was the first way of producing paper from wood. Groundwood pulp was produced at a groundwood plant using grinder stone. Industrial production of this kind of pulp began in Germany, possibly already in 1844. Later, however, two rotating sets of cutters were used to perform the defibration.

Both methods are still used today. However, the traditional method of producing mechanical pulp has been modified by incorporating pressurized conditions into the process in order to recover at least part of the energy used in refining pulp or in grinding at a beneficially high temperature. At the same time, pressurization has decreased the consumption of mechanical energy because the fibre comes off the wood better at a high temperature.

Mechanical pulps which are used for paper making are bleached. Originally, the bleaching was carried out using chlorine compounds and sulphur compounds. Later, new types of bleaching compounds were used, among others, hydrogen peroxide and organic peroxy acids, such as peroxy formic acid and peroxy acetic acid, as described, for instance, in U.S. Pat. No. 4,793,898.

According to FI Patent Publication 68685, it is possible to bleach mechanical pulp by using 0.2-3.0% hydrogen peroxide in the first stage and 0.1-5.0% organic peracid in the second stage. The percentages are calculated from the dry weight of the wood to be processed.

U.S. Pat. No. 4,793,898 suggests that it is possible to bleach pulp by using peroxide together with acetic acid or formic acid, in which case the peroxide used is 20% of the dry weight of the chips. In this case, it is possible to achieve a kappa number of 20 when bleaching birch pulp. It is well known that mixing a small amount of, typically, Mg salts or DTPA (diethylenetriaminepentaacetate) into the bleaching solution will prevent self-decomposition of peroxide.

U.S. Pat. No. 5,039,377 describes a method which is based on peroxide bleaching and in which sodium silicate is used together with an alkali metal carbonate or bicarbonate. Sodium silicate is used in insoluble form and it can be replaced with other siliceous compounds having an ionic exchange capacity, such as synthetic zeolites. In the present case, too, the purpose of the silicate materials is to prevent a premature disintegration of the peroxide, caused by heavy metals.

U.S. Pat. No. 6,743,332 describes how, in a multi-stage TMP process, pulp is bleached using a solution of hydrogen peroxide and Mg(OH)2 and Na2C03, and die fibre suspension is kept in this solution after the second refining stage at a temperature of 185-160° C. for 2-180 minutes. It is recommended that 5-100 kg of peroxide per ton of dry pulp is used.

Furthermore, in U.S. Pat. No. 4,731,160, it is recommended that pulp is bleached with peroxide in the following manner after defibration, the pulp is fractionated into two fractions, which comprise the fines fraction and, correspondingly, the main fraction. The fines fraction is bleached separately because if the two fractions are bleached together, the result is that the drainability of the main fraction is poor and it is not possible to bleach this fraction using a normal filtration bleaching (displacement bleaching) because of the poor drainability. The fines fraction is bleached using the method according to FIG. 1 in the patent specification, in which method the peroxide solution is led into the filtrate water after the last stage. This water is brought back to the pulp after the pressing in the first stage. The bleaching reactions mainly take place in a conventional bleaching tower.

It is an aim of the present invention to eliminate the disadvantages associated with the known technology, and to provide a novel industrially useful process for treating and bleaching mechanical pulp, which is used for manufacturing of fibrous webs, such as cardboard and, above all, paper.

According to our invention, all the planning and implementation of the whole process at industrial scale have been carried out in a totally new way. In the present process, bleaching is focused particularly on the reject fraction separated in the pulp screening. The fibres of this pulp fraction are typically coarse, i.e. their pliability is low and they are poorly fibrillated. A laboratory sheet made from pulp fraction of this type has a low density. In addition, its strength is typically low, and due to its small number of fines its opacity is low. On the other hand, its surface is very coarse.

According to the present invention, the pulp which is generated after the fibrillation is screened in order to separate the reject from the accept, in which case the percentage of the reject separated is at maximum approximately 60% of the total pulp amount. After that, the reject is bleached separate from the accept, and the bleached reject is remixed into the accept.

The method is suitable for the production of mechanical or chemi-mechanical pulps, especially for the production of CTMP pulp and particularly for hardwood pulp or pulps which comprise fibres sourced from deciduous trees.

More specifically, the solution according to the present invention is mainly characterized by what is stated in the characterization part of claim 1.

According to the process, advantages are achieved in the bleaching of pulp and particularly in the increase in strength. At the same time, a substantial amount of energy used in refining is saved. The increase in strength and the decrease in energy used for refining is observable both in the refining of the reject and in the post-refining of the finished mechanical pulp. Especially surprising is this advantageous increase in strength achieved in the post-refining stage.

In the literature, it has been demonstrated that the use of alkalis affects the increase in strength and the consumption of energy in the bleaching of rejects. In this respect, we refer to the articles by Strunk, W. et al: High-Alkalinity Peroxide Treatment of Groundwood Screen Rejects, ABTCP Congr. Annual Celulose Papel 22nd (Sao Paulo), 511-533, Treating Groundwood Screen Rejects with Alkaline Peroxide Ups Pulp Value, Pulp Paper 63, no. 11: 99-105, 1989 and High-Strength Softwood Rejects by Bleaching with Peroxide before Refining, Tappi Ann. Mtg. (Atlanta) Proc.: 49-61, 1988.

In the known solutions, however, large doses of alkali have been used. By contrast, in the present invention, we have unexpectedly discovered that even with small doses of alkali energy is saved and thus, particularly interestingly, the post-refining advantage mentioned above is achieved. In practice, the alkali consumption of the process is not essentially increased in the present invention, because the amount of alkali used for the bleaching of the reject decreases the amount of alkali needed elsewhere, especially in the high-consistency bleaching.

In the following, the present invention will be examined in more detail with the help of a detailed explanation, together with the accompanying drawing. The FIGURE shows a simplified flow sheet of the process according the present invention (i.e. the reject treatment).

In the process according to the present invention, the raw wood material is defibrillated, using mechanical or chemi-mechanical methods which are known per se, to be raw material for paper or cardboard. In the process according to the present invention, the raw wood material is defibrillated, using mechanical or chemi-mechanical methods which are known per se, to render it suitable raw material for paper or cardboard production. Wood chips or wood (blocks) can be used as raw wood material. The fibrillated pulp generated is bleached in alkaline conditions. However, the pulp coming from the fibrillation is first led to the screening stage, where it is divided into at least two parts, namely the accept, which is brought forward to the bleaching stage, and the reject, which undergoes a treatment according to the present invention. The percentage of the reject separated is at maximum approximately 60%, preferably at maximum approximately 40%, of the total pulp amount. However, typically the share of the reject removed is at least 5%, especially at least approximately 10%. The reject is bleached separate from the accept, and after that the bleached reject is mixed into the accept.

It should be pointed out that, although in the following explanation only aspen is mentioned in several places in the text as the starting material for the chemi-mechanical pulp, the present invention can be applied to other wood species of the *Populus* genus, as well. In general, the following wood species, among others, are well suited to be used in the present invention: *P. tremuli, P. tremufoides, P balsamea, P. balsamifera, P. trichocarpa, P. heterophylla, P. deltoides ja P. grandidentata*. Aspen (the European aspen, *P. tremula*; Quaking aspen *P. tremuloides*), aspen species crossbred from different stock aspens, so-called hybrid aspens (for instance *P. tremula x tremuloides, P. tremula x tremula, P. deltoides x trichocarpa, P. trichocarpa x deltoides, P. deltoides x nigra, P. maximowiczii x trichocarpa*) and other species generated by gene technology, along with poplars, are considered to be particularly preferable for the production of chemi-mechanical pulp, the fibre properties and the optical properties of which are good enough to be used in the present invention.

It is preferable to use chemi-mechanical pulp, which has a suitable fibre distribution and at least 30%, most suitably at least 50% and preferably at least 70% of which pulp are sourced from aspen, hybrid aspen or poplar. According to a more preferable application form, a pulp of aspen-CTMP is used in the present invention. At least 20% by weight of the fibres of this pulp are included in the fibre size fraction <200 mesh. Most suitably a pulp of aspen-CTMP is used when 20-40% by weight, preferably approximately 25-35% by weight, of the fibres of this pulp are included in the fibre size fraction 28, 48 mesh, and 20-40% by weight, preferably approximately 25-35% by weight, in the fibre size fraction <200 mesh.

Here, the FIGURE 28/48 means the fibre faction which passes through a wire, the mesh density of which is 28 wires per inch (mesh), but which fraction is rejected by the 48 mesh wire. A fraction like this comprises fibres which give the paper layer a suitable bulk and stiffness. The fraction having the fibres of a size that penetrate the very finest wire (<200 mesh) gives, in turn, a good surface smoothness. The pulp in question can be produced with a chemi-mechanical process which is known per se and which has several refining stages, for instance 2 stages followed by the reject screening and reject refining. The desired fibre size distribution is adjusted by the interaction of these stages.

The above description of the distribution of fibre size typically applies to pulps used in paper making if the grammage is below 150 g/m$^2$ and preferably less than 100 g/m$^2$ (for instance approximately 30-90 g/m$^2$). The fibre size distributions are preferably different for papers and cardboards of bigger grammage.

In the present invention, chemi-mechanical pulp production means a process which comprises two stages, namely a chemical and a mechanical defibration stage. Chemi-mechanical processes are the CMP and CTMP processes. In the CMP process, the raw wood material is refined at normal pressure, whereas in the CTMP process a pressure refiner mechanical pulp is produced. The yield of the CMP process is generally smaller than that of the CTMP process (less than 90%). The reason is that the dosage of chemicals used in the CMP is larger. In both cases the chemical treatment of wood is traditionally carried out with sodium sulphite (sulphonation treatment), in which case broadleaf wood can be treated with sodium hydroxide, too. In that case, a typical chemical dosage in the CTMP process is approximately 0-4% of sodium sulphite and 0.1-7.0% of sodium hydroxide at a temperature of approximately 60-120° C. In the CMP process, the chemical dosage is 10-15% of sodium sulphite and/or 4-8% of sodium hydroxide (the dosages are calculated on the basis dry wood or dry pulp) and the temperature is 130-160° C. and, correspondingly, 50-100° C.

In a chemi-mechanical process, the wood chips can also be impregnated with an alkaline peroxide solution (APMP process). The peroxide dosage is generally 0.1-10.0% (of the dry pulp, kg/adt), typically approximately 0.5-5.0%. The same amount of alkali, such as sodium hydroxide, is added, i.e. approximately 0.1-10.0% by weight.

The raw material of the CTMP process can comprise only aspen or some other wood of the poplar genus. However, other wood species can be included in it, too, such as broadleaf wood, for instance birch, eucalyptus and mixed tropical hardwood, or coniferous wood, such as spruce or pine. According to one application, chemi-mechanical pulp is used, which comprises at least 5% of coniferous wood fibres. In the present invention, it is possible to use for instance chemi-mechanical pulp which comprises 70-100% of aspen fibres and 0-30% of coniferous wood fibres. The latter can be sourced from one or several coniferous wood species.

The bulk, the strength properties and the stiffness of the pulp can be increased by the addition of coniferous wood fibres, particularly spruce fibres. However, it is also possible to affect the bulk and the stiffness of pulp comprising only aspen or a similar starting material by adjusting the process parameters of the CTMP process.

Mechanical defibration methods, i.e. fibrillation methods, are the traditional mechanical pulp method and the refined mechanical pulp method (GW and TMP), and modified versions of them In the treatment of the reject, it is possible to proceed in two ways: either by first bleaching and then refining the reject before it is mixed with the accept, which forms the main body of the pulp; or, alternatively, by refining it before the bleaching. Preferably, the refining is carried out after the bleaching, in which case much energy used for the refining is saved. In both cases 20-60%, preferably 20-40%, of the pulp is separated as the reject, after the fibrillation and the screening.

Peroxide or peracid compounds are used as bleaching chemicals in both the bleaching of the reject and of the accept+reject. Among the peracid compounds, lower peroxy alkane acids, particularly performic acid, peracetic acid and perpropionic acid, together with permonosulphuric acid (Caron acid) and mixtures of them should be mentioned.

Peracetic acid, which is a particularly suitable peroxy alkane acid, is prepared by bringing acetic acid to react with hydrogen peroxide at a molar ratio of 1:1-1:2 by using a small amount of sulphuric acid as a catalyst. Peracetic acid is used either as such or as a balancing product or in a distilled form. Typical conditions required for the treatment stage using peracetic acid are: dose 2-40 kg/BDt, pH 3-8, temperature 50-90° C. and reaction time 30 minutes to 6 hours. When necessary, additives can be included at the peracid stage, for example magnesium sulphate and/or a chelating agent, such as EDTA or DTPA, the amount of which is approximately 0.5-3.0 kg/BDt. More preferably, the conditions necessary for the peracetic acid treatment stage are: pH 4.5-7, reaction time 30-180 minutes and temperature 50-80° C.

The peroxide bleaching, in turn, is carried out with hydrogen peroxide or sodium peroxide. Generally, sodium silicate and magnesium sulphate are added to the bleaching solution to stabilize the peroxide. The bleaching is carried out in alkaline conditions and the pH value is generally approximately 9-12 at the initial stage of the bleaching. The peroxide dose is typically approximately 0.5-10.0%, and even a dose of 1-3% gives good bleaching results. The consistency of the pulp is approximately 5-40% and the retention time of the bleaching is, depending on the temperature and the consistency, approximately 0.1-20.0 hours, typically approximately 0.5-4.0 hours, at the consistency of 5-40%. It is possible to improve the ISO brightness of the pulp by approximately 15-20 percentage units by using peroxide bleaching.

Alkali, especially alkali metal hydroxide, such as sodium hydroxide, is dosed to bleach the reject in the same volumes as peroxide, typically the percentage of alkali is approximately 0.5-1.0 times, especially 0.6-0.8 times, the percentage of peroxide. The dosage of alkali brought to the bleaching is approximately 0.2-3.0% of the dry weight of the pulp. The dosage is most suitably at maximum approximately 2.0%, especially approximately 0.1-1.5%. Because, in the present invention, the total consumption of alkali remains essentially constant when compared with a conventional process, typically at least 10% but at maximum approximately half of the alkali used in the whole bleaching process, especially approximately 20-45% by weight of the total bleaching amount of the pulp, is used in the bleaching of the reject.

The reject which is separately bleached is post-refined before it is mixed with the accept. Expressed in terms of specific energy consumption, 15-30% of the main line energy used for refining is used for the refining of the reject.

The main body of the pulp, i.e. the accept, and the reject are recombined after being treated separately, and they are typically bleached and washed together. The recombined pulp is bleached to a desired final brightness, as described above, with peroxide or peroxy acid. The CTMP process in particular permits the pulp to still be dried and in turn compressed into bales prior to being delivered to the paper or cardboard mill. In order to produce in a more preferable way the unexpected changes achieved in the bleaching of the reject, a post-refining step is carried out on the composite pulp (accept+reject), which uses 10-1000 kWh/t, preferably 10-400 kWh/t, of energy for the refining. In principle, this post-refining can take place at any stage after the recombining of the accept and the reject, and it can be carried out using either the high-consistency or the low-consistency technique, although the most typical form of application today is low-consistency refining. The most suitable moment at which post-refining, such as the low-consistency refining mentioned above, is carried out is before the pulp is dosed to the paper or cardboard machine.

The composite pulp is bleached to a desired final brightness, as described above, using peroxide or peroxy acid in an alkaline intermediate agent. According to the present invention, in high-consistency bleaching, the dosage of alkali can be less than the conventional dosage. Typically, it is approximately 0.5-1.5%. The dosage of peroxide can be decreased, too, in which case approximately 3.0% (typically 1.0-3.0%) can be set as the upper limit.

The alkali consumption of the process is all together (impregnation+medium-consistency bleaching+treatment/bleaching of the reject) approximately 2-4% of the pulp (kg/adt), especially at maximum approximately 3.5%.

On the basis of what is presented above, the process is described in the following example, together with a process flowchart. The main stages of the process are the treatment of wood chips, absorption, refining, screening, treatment of reject, bleaching and washing.

In the process flowchart, the reference numbers 1-12 refer to the following process stages and containers:

1. Refining
2. Containers for removal of latency
3. Primary stage screening
4. Secondary stage screening
5. Reject containers
6. Concentration of reject
7. Compression of reject
8. Bleaching of reject
9. Refining of reject
10. Container for refined reject
11. Screening of reject
12. Centrifugal cleaning A. Treatment of Wood Chips Aspen and for some types of pulp spruce are used as raw material for the chemi-mechanical pulping process (BCTMP). The spruce chips are delivered to the mill as prepared chips. The aspen is barked at the debarking plant by using the dry barking process. The barked blocks are chipped and the chips are screened. The chips are stored in four covered chip storage silos.

The chips are first heated in the chip silo, after which rocks, sand and other impurities are washed away by circulating water. The washing water is separated from the chips in a water separation screw.

B. Impregnation

The washed chips are heated with steam in a pressurized feed screw. After that, the chips are strongly compressed and then they are swelled to enhance the absorption of the chemicals.

C. Refining

The impregnated chips are led to a one or two-stage pressurized refining process. From the refining, the pulp is led into latency removal containers.

D. Screening

After the mechanical defibration, the pulp still contains incompletely defibred fragments and slivers. These are separated from the pulp in a multi-stage screening process and, after that, they are led to the reject treatment stage.

E. Treatment of the Reject

The treatment of the reject is described in FIG. 1. The impregnated chips are led to the refining stage 1, after which the pulp is pumped to the latency removal stage 2. Subsequently, the pulp is pumped, at a consistency of 1.4-1.8% to the screening 3 of the primary stage (P-stage), from where the accept flow is pumped to the disc filter. The reject at P-stage 3 is always pumped, according to the processed wood species, either to the screening 4 of the secondary stage (S-stage) or to the reject containers 5. The volumetric ratio of the reject at the P-stage is determined according to the pressed species and the status of the process, being between 25 and 40%. The accept from the screening of the S-stage is fed into the pulp flow going to the disc filter, and the reject of the screening 4 of the S-stage is pumped into the reject containers 5. At the S-stage, the volumetric ratio of the reject varies between 47 and 57%, depending on the status of the process.

From the reject container, pulp is pumped to the reject concentration stage 6, which can be carried out, for instance with curved screens, to concentrate the pulp. Before the bleaching of the reject, the pulp is washed and water is removed from it by the reject presses 7. From the reject presses, the HC-consistency 28-38% pulp is led through the chemical mixer into the reject bleaching tower 8. In the chemical mixer, the bleaching chemicals, the alkali and the peroxide and/or the percompounds are added.

After the bleaching, the pulp is refined in the reject refining stage 9. From the reject refining stage 9, the pulp is led into the refined reject container 10, from where the pulp is pumped to the reject screening 11. The accept from the reject screening is led to the same flow together with the accept from the screening 3 of the P-stage, and the reject is fed to the centrifugal cleaning 12. At the reject screens, the volumetric ratio of the reject is 20-35%, depending on the processed wood species. The accept from the centrifugal cleaning 12 is pumped into the reject containers 5, from where it circulates again through the whole reject treatment. The reject from the centrifugal cleaning 12 is led out of the process. The reject from the reject screening (30-60% of the pulp flow) is recirculated into the reject containers 5, from where it circulates again through the whole reject treatment.

F. Bleaching and Washings

The pulp is washed by diluting it with the circulating water that is cleaner and by compressing it in screw presses, at the first washing stage. In a two-stage bleaching process, besides bleaching of the reject, the pulp is bleached with peroxide. The first bleaching is carried out at a consistency of approximately 12% (MC bleaching) and the second at a consistency of approximately 30% (HC bleaching). Between the bleaching stages, there is a second washing stage, which is carried out at the double wire presses. The use of chemicals is optimized, because in the MC bleaching, hydrogen peroxide is generally not added. Instead, washing waters comprising residual peroxide from the second bleaching stage are circulated into it.

The bleaching is followed by a three-stage washing process. This washing is based on counter-current washing, i.e. circulating of dilution waters coming from the following washings. After the fourth washing stage, the pulp is diluted, using the clean condensate from the evaporation, to MC-consistency and led into the storage tower.

G. Drying and Baling of the Pulp

The compressed pulp is led from the storage tower to two flash drying lines, which have two stages. The pulp is flocculated and then led into a current of hot air. After that, the pulp is led through a blower to a cooling cyclone, from where the dried pulp is in turn led to the bale forming devices.

By following the process described above, the results shown in the next example were achieved. It should be pointed out that the properties of wood vary according to the time of the year and the geographical area whence the trees came, and according to the latitude. This is obvious to experts in the field. Consequently, this must be taken into account when looking at the numbers of the following table, even though the two large-scale trial runs were planned to be carried out using trees, the cutting sites of which were as close to each other and as similar as possible.

| | time | |
|---|---|---|
| | 26 Sep. 2004 | 19 Oct. 2004 |
| Pulp preparation: | | |
| Impregnation NaOH kg/adt | 2 | 2 |
| Oxidized green liquor kg/adt | 6 | 6 |
| DTPA kg/adt | 0.6 | 0.8 |
| Refining/line 1 SRE MWh/adt | 1.59 | 1.66 |
| line 2 | 1.77 | 1.64 |
| Screening: | | |
| DTPA to the latency tower kg/adt | 0.6 | 0.8 |
| Volumetric reject % (with a volumetric ratio of 35%, the ratio of reject to pulp is 40-45%, depending on the input consistency and the feeding flow) | 35 | 38 |
| Average consistency bleaching | | |
| NaOH kg/adt | 1 | 1 |
| High consistency bleaching | | |
| $H_2O_2$ kg/adt | 37 | 28 |
| NaOH | 19 | 12 |
| MgSO4 | 2.5 | 1 |
| Reject treatment: | | |
| $H_2O_2$ kg/adt | 0 | 12 |
| NaOH | 0 | 12 |
| MgSO4 | 0 | 0.03 |
| Separate refining of reject | | |
| RJ 1 MWh/adt | 0.64 | 0.29 |
| RJ 2 MWh/adt | 0.68 | 0.39 |
| Volumetric amount of reject in the reject screening | 35% | 28% |
| Total amount of NaOH kg/adt | 27 | 32 |
| Properties, measured from a sheet tested after the pulp production: | | |
| *CSF ml | 10 | 100 |
| Bulk $cm^3/g$ | 2.00 | 1.86 |
| Benzene ml/min | 435 | 254 |
| Tensile index Nm/g | 31.2 | 38.3 |
| Tensile stiffness kNm/g | 4.17 | 5.08 |
| Tensile energy index TEA J/g | 0.31 | 0.43 |
| Delamination energy = Scott Bond $J/m^2$ | 177 | 188 |
| ISO brightness % | 83.2 | 81.5 |
| Opacity % | 81.7 | 80.8 |
| Properties, after the pulp has been post-refined in a low consistency refiner 60 kWh/adt (the refiner is a laboratory scale Voith-Sulzer conical refiner) | | |
| CFS ml | 84 | 70 |
| Bulk $cm^3/g$ | 1.84 | 1.72 |
| Benzene ml/min | 246 | 106 |
| Tensile index Nm/g | 37.0 | 46.2 |
| TEA J/g | 0.41 | 0.56 |
| Delamination energy $J/m^2$ | 215 | 252 |
| ISO brightness % | 82.9 | 81.4 |
| Opacity % | 81.7 | 80.4 |

*indicates that the other typical properties were so close to each other that it is not worth mentioning them in this comparison.

The comparison shows that the Bentsen smoothness of the test sheets from both the pulp production and, particularly, from the post-refining, together with the tensile index and the delamination energy, were considerably improved. Altogether, it can be seen how the properties of pulp, which is processed with the method according to the present invention, have developed in a positive direction in a very unexpected way in the post-refining, when the comparison is made on the basis of the energy consumption in the post-refining. At the same time, the energy used in the refining of the reject in the actual pulp production dropped to approximately half. One feature which cannot be presented in this comparison, but which is obvious to experts, is that the amount of the reject can inherently vary and, consequently, if its properties are affected in a way described above, the quality of the pulp and thus in turn the quality of the final paper will be substantially improved, and the quality fluctuations evened out.

In the above example, a wood mixture was used comprising 85% of aspen and 15% of spruce.

A corresponding procedure is suitable for spruce, too, when it is used to produce refined mechanical pulp, groundwood pulp or chemi-mechanical refiner pulp, or treatments of them carried out under pressurized conditions.

The example also illustrates that the total consumption of alkali is essentially the same in the solution according to the present invention. In the example according to the present invention, the FIGURE was 3.2% (kg/adt), whereas the amount used in the conventional method was 2.7%.

The invention claimed is:

1. Method for producing mechanical or chemi-mechanical pulp as raw material for paper or cardboard, comprising the following steps:

the pulp is fibrillated in a main line, using methods which are known per se, from wood chips or wood, and the fibrillated pulp is bleached in alkaline conditions, characterized in that after the fibrillation, the pulp is screened to separate the reject from the accept, at maximum 60 of the total pulp amount is separated as reject, the reject is bleached apart from the accept with peroxide or peracid forming a bleached reject and, after that, the bleached reject is separately refined forming a bleached and refined reject and then mixed with the accept, the accept and the bleached and refined reject being post-refined together using 10 to 1000 kWh/ton.

2. The method according to claim 1, characterized in that approximately 20-40% of the pulp is separated as reject, after the fibrillation and the screening.

3. The method according to claim 1, characterized in that, expressed as specific energy, 15-30 of the refining energy of the main line is used for the refining of the reject.

4. The method according to claim 1, characterized in that the accept and the bleached and refined reject being post-refined together using 10-400 kWh/ton.

5. The method according to claim 4, characterized in that the accept and the bleached and refined reject being post-refined at low consistency.

6. The method according to claim 4, characterized in that the post-refined pulp is dosed at a paper or cardboard machine.

7. The method according to claim 1, characterized in that the reject is bleached in an alkaline intermediate agent, in which case the amount of alkali used in this bleaching is 10-50% by weight of the total amount of the pulp to be bleached.

8. The method according to claim 1, characterized in that the alkali consumption of the process is all together approximately 2-4% of the weight of the pulp in terms of kg/adt.

9. The method according to claim 7, wherein the amount of alkali used in the bleaching of the reject in the alkaline intermediate agent is approximately 20-45% by weight of the total amount of the pulp to be bleached.

10. The method according to claim 8, wherein the alkali consumption of the process is all together 2-3.5% of the weight of the pulp in terms of kg/adt.

* * * * *